US009376991B2

(12) United States Patent
Dudar et al.

(10) Patent No.: US 9,376,991 B2
(45) Date of Patent: Jun. 28, 2016

(54) PASSIVE VENTURI PUMP FOR LEAK DIAGNOSTICS AND REFUELING

(75) Inventors: Aed M. Dudar, Canton, MI (US); Robert Roy Jentz, Westland, MI (US); Russell Randall Pearce, Ann Arbor, MI (US); Scott A. Bohr, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 786 days.

(21) Appl. No.: 13/557,146

(22) Filed: Jul. 24, 2012

(65) Prior Publication Data

US 2014/0026865 A1 Jan. 30, 2014

(51) Int. Cl.
*F02M 37/10* (2006.01)
*F02M 25/08* (2006.01)

(52) U.S. Cl.
CPC ..... *F02M 37/106* (2013.01); *F02M 25/0818* (2013.01)

(58) Field of Classification Search
CPC ..... F02M 33/02; F02M 25/0809; F02M 25/0872; F02D 41/0032; F02D 41/003; F02D 2200/501; B60K 15/03504; B60K 2015/03514; B60K 2015/03557; B60K 2015/03571; B60K 2015/03576
USPC ..... 123/518, 520, 521, 447, 516, 568.27; 180/65.21; 903/904
See application file for complete search history.

(56) References Cited

U.S. PATENT DOCUMENTS 4,454,855 A * 6/1984 Otobe ..... F02M 26/57 123/478
4,843,558 A * 6/1989 Bergmann ..... F02D 41/2422 123/406.44

(Continued)

OTHER PUBLICATIONS

Anonymous, "An EVAP Purge Method for GTDI Engines," IPCOM No. 000233166, Published Nov. 27, 2013, 2 pages.

(Continued)

*Primary Examiner* — Hung Q Nguyen
*Assistant Examiner* — John Bailey
(74) *Attorney, Agent, or Firm* — James Dottavio; Alleman Hall McCoy Russell & Tuttle LLP

(57) ABSTRACT

Systems and methods for operating a hybrid electric vehicle with a passive venturi pump are disclosed. In one example approach, a method comprises: during vehicle motion, passing air through a venturi coupled to the vehicle to generate vacuum; storing the generated in an accumulator; and, in response to a condition, discharging the stored vacuum to a vacuum consuming system of the vehicle.

18 Claims, 7 Drawing Sheets

(56) References Cited

U.S. PATENT DOCUMENTS 4,899,708 A * 2/1990 Jung ..... B60T 8/448 123/337
5,054,454 A * 10/1991 Hamburg ..... F02D 41/004 123/520
5,295,472 A * 3/1994 Otsuka ..... F02M 25/0809 123/198 D
5,390,645 A * 2/1995 Cook ..... F02M 25/0818 123/198 D
5,460,149 A * 10/1995 Tofel ..... F02M 7/11 123/676
5,499,616 A * 3/1996 Enright ..... F01M 13/023 123/572
5,651,349 A * 7/1997 Dykstra ..... F02M 25/0809 123/198 D
5,727,531 A * 3/1998 Osanai ..... F02M 25/0872 123/306
5,901,689 A * 5/1999 Kimura ..... B60K 15/03504 123/518
5,975,062 A * 11/1999 Bonse ..... F02M 25/0818 123/519
6,182,642 B1 * 2/2001 Ohkuma ..... F02M 25/0818 123/519
6,220,229 B1 * 4/2001 Kawamura ..... F02M 25/0809 123/520
6,220,230 B1 * 4/2001 Kawamura ..... F02M 25/0809 123/520
6,279,548 B1 * 8/2001 Reddy ..... B01D 53/02 123/519
6,308,119 B1 * 10/2001 Majkowski ..... F02M 25/0809 123/520
6,338,253 B1 * 1/2002 Freedman ..... F17C 7/04 62/48.1
6,557,534 B2 * 5/2003 Robichaux ..... B60K 6/445 123/179.16
6,634,342 B1 * 10/2003 Wouters ..... B60K 15/035 123/516
6,722,348 B2 * 4/2004 Nagasaki ..... F02M 25/0818 123/198 D
6,772,739 B2 * 8/2004 Veinotte ..... F02M 25/0809 123/516
7,069,916 B2 * 7/2006 Osanai ..... F02M 25/089 123/516
7,204,237 B2 * 4/2007 Booms ..... F02M 25/0809 123/198 D
7,216,635 B1 * 5/2007 Roche ..... F02M 37/20 123/198 D
7,311,089 B2 * 12/2007 Balsdon ..... F02M 25/0836 123/519
7,331,335 B2 * 2/2008 Okuda ..... F02M 25/0836 123/519
7,347,191 B2 * 3/2008 Atwood ..... B60K 15/035 123/516
7,350,512 B1 * 4/2008 Meacham ..... F02M 25/0809 123/516
7,387,014 B2 * 6/2008 Banyard ..... F04F 5/52 73/40.5 R
7,441,549 B2 * 10/2008 Takayanagi ..... F02M 25/0818 123/520
7,448,367 B1 * 11/2008 Reddy ..... B60K 15/03519 123/519
7,506,639 B2 * 3/2009 Saito ..... F02M 25/0827 123/518
7,610,906 B2 * 11/2009 Takakura ..... F02M 25/089 123/520
8,019,525 B2 * 9/2011 DeBastos ..... B60K 15/03504 123/520
8,056,540 B2 * 11/2011 DeBastos ..... F02M 25/0818 123/520
8,074,627 B2 * 12/2011 Siddiqui ..... F02M 25/0818 123/516
8,132,560 B2 * 3/2012 Ulrey ..... F02M 25/089 123/521
8,196,567 B2 * 6/2012 Pursifull ..... F02M 37/0064 123/198 D
8,200,411 B2 * 6/2012 DeBastos ..... B60K 15/03504 123/520
8,382,072 B1 * 2/2013 Galka ..... F02M 7/12 251/129.15
2002/0083930 A1 * 7/2002 Robichaux ..... B60K 6/445 123/520
2005/0011185 A1 * 1/2005 Annoura ..... F02D 41/0032 60/289
2007/0113833 A1 * 5/2007 Balsdon ..... F02M 25/0836 123/520
2007/0181103 A1 * 8/2007 Okuda ..... F02M 25/089 123/520
2008/0250564 A1 * 10/2008 Stryker ..... A61G 7/001 5/615
2009/0277251 A1 * 11/2009 Takakura ..... F02M 25/0809 73/40.7
2009/0288645 A1 * 11/2009 Childress ..... F02M 25/089 123/520
2009/0293599 A1 * 12/2009 McLain ..... F02M 25/0827 73/114.39
2010/0223984 A1 * 9/2010 Pursifull ..... F02M 25/0836 73/114.39
2010/0224171 A1 * 9/2010 Peters ..... F02M 25/089 123/520
2010/0257852 A1 * 10/2010 McCormick ..... B60T 1/10 60/327
2011/0030658 A1 * 2/2011 Ulrey ..... F02M 25/089 123/521
2011/0030659 A1 * 2/2011 Ulrey ..... F02M 25/089 123/521
2011/0132331 A1 * 6/2011 Pursifull ..... F02B 37/127 123/478
2011/0139130 A1 * 6/2011 Siddiqui ..... F02M 25/0818 123/520
2011/0166765 A1 * 7/2011 DeBastos ..... B60K 15/03504 701/102
2011/0168140 A1 * 7/2011 DeBastos ..... F02M 25/0818 123/521
2011/0197862 A1 * 8/2011 Der Manuelian .. F02M 25/0809 123/521
2011/0265768 A1 * 11/2011 Kerns ..... F02M 25/089 123/521
2011/0290203 A1 * 12/2011 Pursifull ..... F02D 19/0605 123/41.08
2011/0295482 A1 * 12/2011 Pearce ..... B60K 15/03504 701/102
2011/0307157 A1 * 12/2011 Pursifull ..... F02D 41/0007 701/102
2011/0308302 A1 * 12/2011 Makino ..... F02M 25/0836 73/40.7
2012/0152210 A1 * 6/2012 Reddy ..... F02M 25/089 123/520

OTHER PUBLICATIONS

Anonymous, "A Combined Aspirator With an Integrated Dual Check Valve Assembly," IPCOM No. 000239163, Published Oct. 17, 2014, 4 pages.

Anonymous, "Green Fuel Tank Refueling Method," IPCOM No. 000239371, Published Nov. 3, 2014, 2 pages.

* cited by examiner

PASSIVE VENTURI PUMP FOR LEAK DIAGNOSTICS AND REFUELING

BACKGROUND AND SUMMARY

Fuel systems including fuel tanks may be used to store and provide fuel to engines. For example, a vehicle including an internal combustion engine may include a fuel tank that stores liquid fuels such as gasoline, diesel, methanol, ethanol, and/or other fuels.

Liquid fuels in a fuel tank may evaporate into fuel vapors in the tanks. As such, various fuel vapor management systems may be included in a fuel system. Such fuel systems may be substantially sealed from the atmosphere but may include components configured to vent the fuel system to the atmosphere during certain conditions. For example, a fuel system may include a vapor purge canister for filtering fuel vapors during venting.

If there are leaks in the fuel system, e.g., if there are leaks in the fuel tank, canister or any other component of the vapor handling system, then fuel vapor may escape to the atmosphere contributing to vehicle emissions, for example. Various approaches to diagnosing leaks in vehicle fuel systems are known. In one approach, leak testing is achieved by utilizing a vehicle engine to create a vacuum within the fuel tank and measuring pressure changes over a time period.

In some approaches, engine off natural vacuum (EONV) may be employed for leak testing in a hybrid vehicle system. For example, a normally open canister vent may be closed and a decrease in vacuum may be measured over a long period of time. Such approaches may use correlations between temperature and vacuum build. However, the inventors herein have recognized a number of issues with such EONV approaches. For example, additional hardware and software may increase costs, and long test times in may reduce the feasibility of carrying out a leak test. Additionally, such EONV approaches may degrade during hot ambient temperature conditions. Further, such EONV approaches may not be sufficiently accurate for leak testing, e.g., due to unreliable correlations between temperature and vacuum build (e.g., due to mass transfer between the liquid and vapor in a fuel tank).

In one example approach, an external electric vacuum pump may be used to create a vacuum to perform a leak test in a hybrid vehicle system. However, the inventors herein have recognized that such an approach may increase material and installation costs associated with the installation of such an external electric vacuum pump and associated hardware and software. Further, such active pumps can be costly, noisy, and consume electric power which drains the battery and may result in a fuel economy penalty.

In order to at least partially address these issues, a method for operating a vehicle with an engine comprises: during vehicle motion, passing air through a venturi coupled to the vehicle to generate vacuum; storing the generated in an accumulator; and, in response to a condition, discharging the stored vacuum to a vacuum consuming system of the vehicle. For example, the condition may be an engine-off event, a key-off event, or a refuel event request and the vacuum consuming system may be a fuel system of the vehicle or a fuel evaporative system of the vehicle.

In this way, a passive device that generates vacuum from vehicle motion may be used to provide vacuum to vacuum-consuming vehicle systems. Specifically, by storing the passively generated vacuum, and coordinating the transfer of the stored vacuum to vehicle systems with vehicle operating conditions, it is possible to meet diagnostic and operating requirements even though vacuum is not able to be generated under all vehicle operating conditions. In this approach, costs and noise associated with an active pump may be reduced and, since no power is used to run the passive venturi, vehicle fuel economy may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
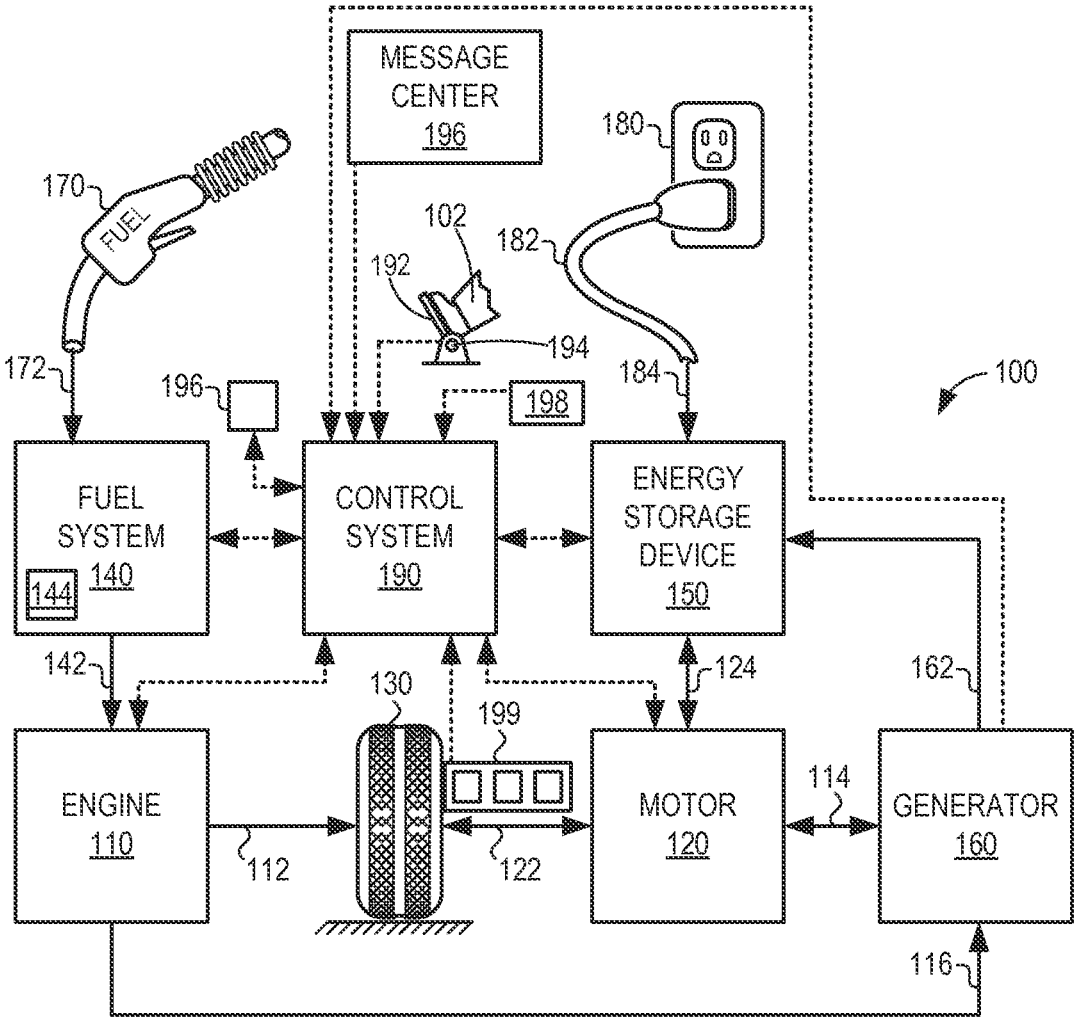
FIG. 1 shows a schematic depiction of a hybrid vehicle.
Figure 2:
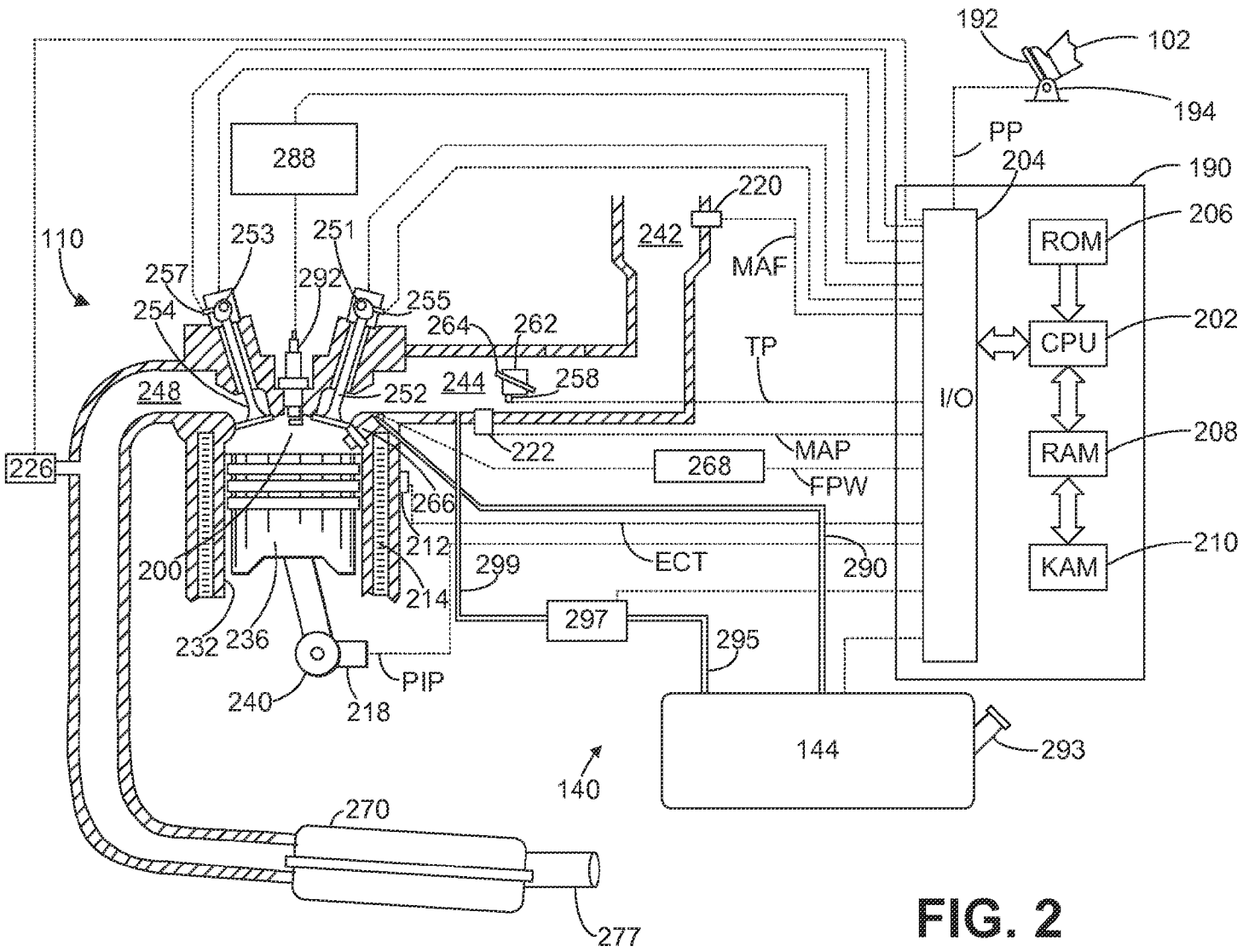
FIG. 2 shows a schematic depiction of an internal combustion engine.

The following description relates to systems and methods for operating a hybrid electric vehicle with a passive venturi pump, such as the example hybrid vehicle shown in FIG. 1. Such vehicles may include internal combustion engines fueled by a fuel system, such as shown in FIG. 2. A passive venturi pump may be included in the hybrid electric vehicle to generate vacuum during vehicle movement and, under certain conditions, vacuum generated by the venturi may be stored in an accumulator device. Vacuum stored in the accumulator device may be used, during select conditions, by vacuum consuming systems such as a fuel system shown in FIG. 3. FIG. 4 shows an example method for generating, storing, and utilizing vacuum in a vehicle system which includes a passive venturi vacuum pump. For example, leaks may be diagnosed in a vehicle fuel system as shown in the example method of FIG. 5 by monitoring pressure changes as shown in FIG. 6, for example. Further, stored vacuum may be used to decrease pressure in a fuel tank for refueling as shown in the example method of FIG. 7.

Turning now to FIG. 1 a schematic example vehicle propulsion system 100 is shown. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 white engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160. As described in more detail below, fuel system 140 may include a variety of components configured to detect leaks in the fuel system.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Additionally, a variety of sensors may be employed for leak testing. For example one or more component in the fuel system may include pressure and/or temperature sensors for monitoring pressure and/or temperature changes during a leak test. Examples of such sensors are described in more detail below.

In some examples, energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by an energy source other than the fuel utilised by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication lamp indicated at 196.

The vehicle propulsion system 100 may also include a message center 196, ambient temperature/humidity sensor 198, and a roll stability control sensor, such as a lateral and/or longitudinal and/or yaw rate sensor(s) 199. The message center may include indicator light(s) and/or a text-based display in which messages are displayed to an operator, such as a message requesting an operator input to start the engine, as discussed below. The message center may also include various input portions for receiving an operator input, such as buttons, touch screens, voice input/recognition, etc. In an alternative embodiment, the message center may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic diagram of one cylinder of multi-cylinder engine 110 which may be included in a propulsion system of an automobile, such as the example automobile shown in FIG. 1.

Engine 110 may be controlled at least partially by a control system including controller 190 and by input from a vehicle operator 102 via an input device 192. In this example, input device 192 includes an accelerator pedal and a pedal position sensor 194 for generating a proportional pedal position signal PP.

Note that cylinder 200 may correspond to one of a plurality of engine cylinders. Cylinder 200 is at least partially defined by combustion chamber walls 232 and piston 236. Piston 236 may be coupled to a crankshaft 240 via a connecting rod, along with other pistons of the engine. Crankshaft 240 may be operatively coupled with drive wheel 130, motor 120 or generator 160 via a transmission.

Combustion chamber 200 may receive intake air from intake manifold 244 via intake passage 242. Intake passage 242 may also communicate with other cylinders of engine 110. Intake passage 242 may include a throttle 262 including a throttle plate 264 that may be adjusted by control system 190 to vary the flow of intake air that is provided to the engine cylinders. The position of throttle plate 264 may be provided to controller 190 by throttle position signal TP from a throttle position sensor 258. Cylinder 200 can communicate with intake passage 242 via one or more intake valves 252. Cylinder 200 may exhaust products of combustion via an exhaust passage 248. Cylinder 200 can communicate with exhaust passage 248 via one or more exhaust valves 254.

In some embodiments, cylinder 200 may optionally include a spark plug 292, which may be actuated by an ignition system 288. A fuel injector 266 may be provided in the cylinder to deliver fuel directly thereto. However, in other embodiments, the fuel injector may be arranged within intake passage 242 upstream of intake valve 252. Fuel injector 266 may be actuated by a driver 268.

A non-limiting example of control system 190 is depicted schematically in FIG. 2. Control system 190 may include a processing subsystem (CPU) 202, which may include one or more processors. CPU 202 may communicate with memory, including one or more of read-only memory (ROM) 206, random-access memory (RAM) 208, and keep-alive memory (KAM) 210. As a non-limiting example, this memory may store instructions that are executable by the processing subsystem. The process flows, functionality, and methods described herein may be represented as instructions stored at the memory of the control system that may be executed by the processing subsystem.

CPU 202 can communicate with various sensors and actuators of engine 110 via an input/output device 204. As a non-limiting example, these sensors may provide sensory feedback in the form of operating condition information to the control system, and may include: an indication of mass airflow (MAF) through intake passage 242 via sensor 220, an indication of manifold air pressure (MAP) via sensor 222, an indication of throttle position (TP) via throttle 262, an indication of engine coolant temperature (ECT) via sensor 212 which may communicate with coolant passage 214, an indication of engine speed (PIP) via sensor 218, an indication of exhaust gas oxygen content (EGO) via exhaust gas composition sensor 226, an indication of intake valve position via sensor 255, and an indication of exhaust valve position via sensor 257, among others.

Furthermore, the control system may control operation of the engine 110, including cylinder 200 via one or more of the following actuators: driver 268 to vary fuel injection timing and quantity, ignition system 288 to vary spark timing and energy, intake valve actuator 251 to vary intake valve timing, exhaust valve actuator 253 to vary exhaust valve timing, and throttle 262 to vary the position of throttle plate 264, among others. Note that intake and exhaust valve actuators 251 and 253 may include electromagnetic valve actuators (EVA) and/or cam-follower based actuators.

Though engine 110 is shown in FIG. 2 as a normally aspirated engine, in some examples, engine 110 may include a boosting device such as turbocharger or supercharger. For example engine 110 may include a compressor and/or a turbine communicating via a shaft.

In some examples, an emission control device 270 may be coupled to the exhaust passage. Emission control device 270 can include multiple catalyst bricks, in one example. In another example, multiple emission control devices, each with multiple bricks, can be used. In some examples, emission control device 270 may be a three-way type catalyst. In other examples, example emission control device 270 may include one or a plurality of a diesel oxidation catalyst (DOC), selective catalytic reduction catalyst (SCR), and a diesel particulate filter (DPF). After passing through emission control device 270, exhaust gas is directed to a tailpipe 277.

Fuel may be supplied to engine 110 via a fuel system shown generally at 140 in FIG. 2. A variety of fuel system types may be employed to provide fuel to engine 110. For example, fuel system 140 may be a return-less fuel system or a return fuel system.

Fuel system 140 may include a fuel tank 144 with a fuel pump system for delivering fuel via a liquid fuel line 290 the fuel injectors of engine 110 (e.g., fuel injector 266). Fuel tank 144 may include a refueling line 293, wherein fuel may be supplied to the fuel tank for subsequent use by engine 110.

Vapors generated in fuel tank 144 may be routed to a fuel vapor recovery system 297 via a vapor line 295 coupled to the fuel tank. In some examples under certain conditions, the fuel vapor recovery system 297 may deliver vaporized fuel to engine 110 via a fuel vapor delivery line 299. For example, in some examples, during certain conditions fuel vapor may be delivered to intake manifold 244, e.g. during a purge of a fuel vapor canister in the fuel vapor recovery system. Additionally, during certain conditions, leak testing may be performed in the fuel tank and/or one or more components of the fuel vapor recovery system, e.g., the fuel vapor canister. An example fuel system is described in more detail below with regard to FIG. 3.

Figure 3:
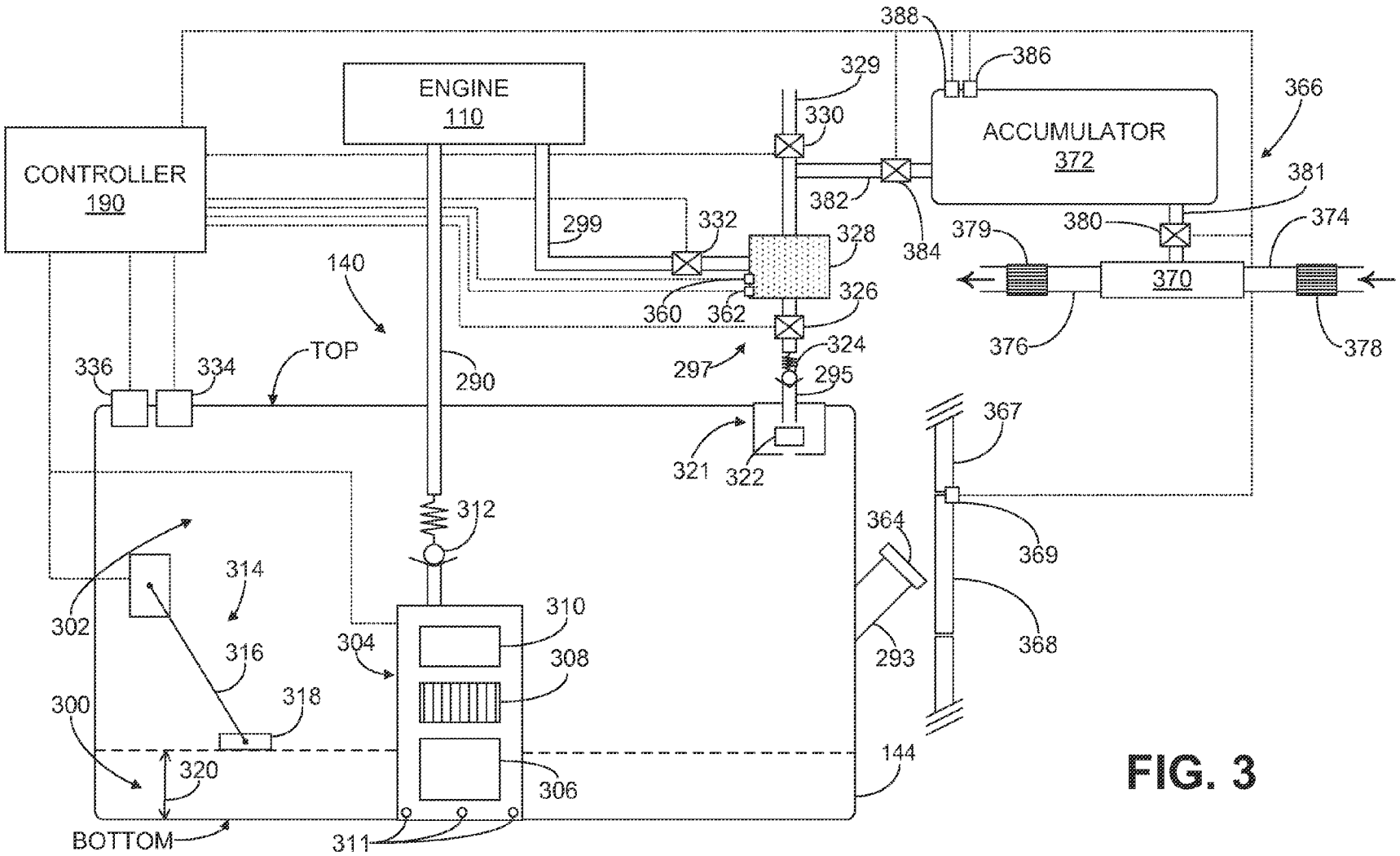
FIG. 3 shows a schematic depiction of a passive venturi pump interfaced with a fuel system.
Figure 4:
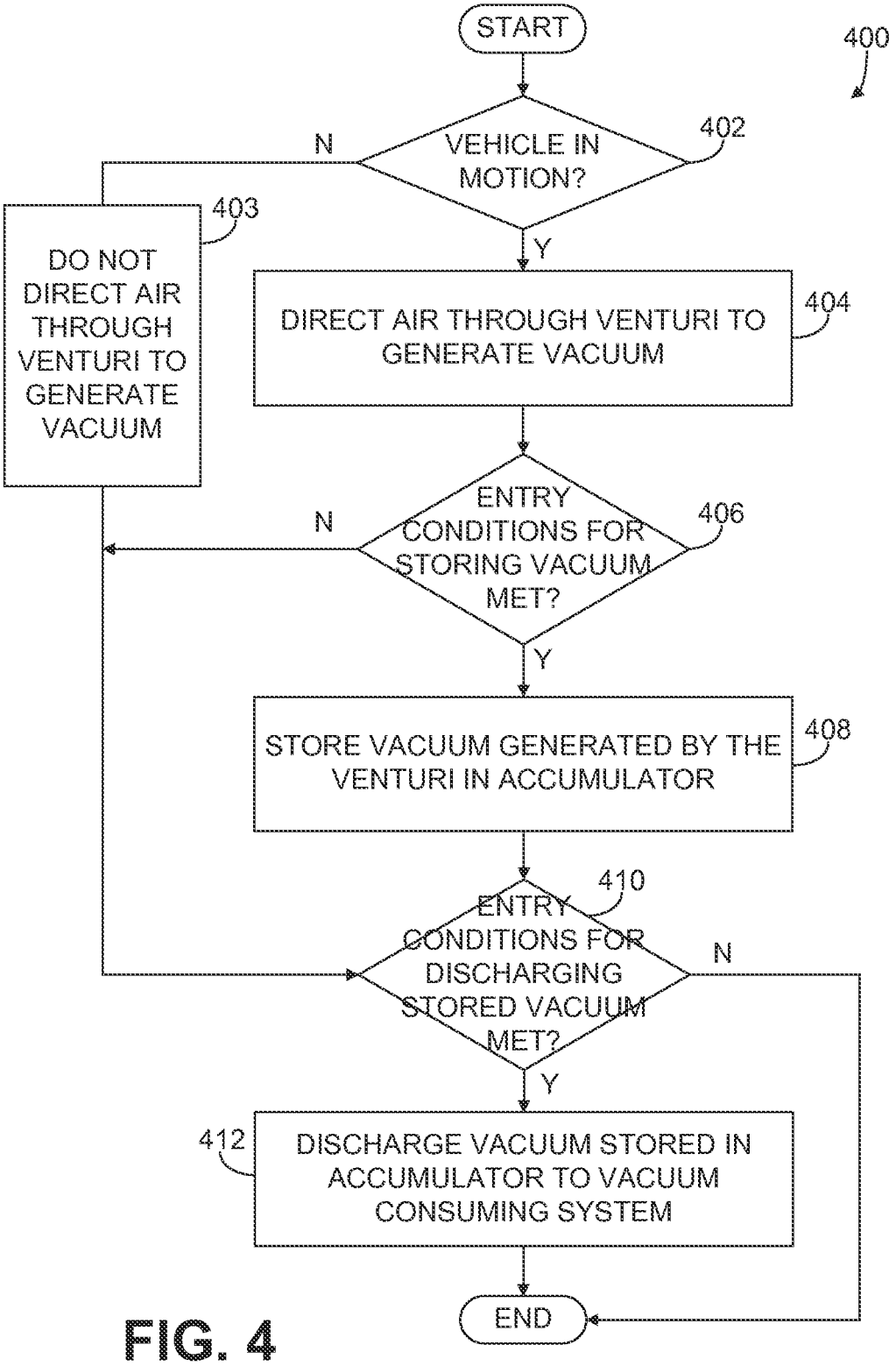
FIG. 4 shows an example method for operating a vehicle with an engine in accordance with the disclosure.

FIG. 3 shows a schematic depiction of a passive venturi pump and vacuum accumulator system 366 interfaced with an example fuel system 140. Fuel system 140 is configured to store and deliver fuel to an engine, e.g. engine 110. In some examples, such an engine may be included in a hybrid vehicle, such as the example hybrid vehicle shown in FIG. 1.

Liquid fuel (e.g., gasoline, ethanol, or blends thereof) may be supplied to fuel tank 144 via refueling line 293. Thus, fuel tank 144 may include a quantity of liquid fuel 300 and a quantity of vapor fuel 302. For example, vapor fuel 302 may form in fuel tank 144 due to evaporation of the liquid fuel contained therein. The fuel tank may be substantially gas-tight under certain conditions and may be formed of a polymer material, metal material, or the like to accumulate and contain evaporative fuel such a gasoline.

The refueling line may include a fuel cap 364 for evaporatively sealing the refueling line. Refueling line 293 may be positioned behind an external side 367 of a vehicle. For example, side 367 may enclose refueling line 293 and may include a refueling door 368 which may be actuated via a refueling door actuator 369 to unlock or open in response to certain conditions. For example, as described below, refueling door 368 may be unlocked or opened in response to a pressure in the fuel tank being below a threshold pressure so that fuel may be added to the fuel tank safely. In some examples, the refueling door may be locked during engine operation and/or when pressure in the fuel tank, e.g., as measured by pressure sensor 334 disposed in fuel tank 144, is above a threshold pressure value, e.g., above 10' H20. When the pressure in the fuel tank falls below the pressure threshold the refueling door may be unlocked or activated via actuator 369 so that refueling can take place.

The fuel tank may have a specified orientation. For example, fuel tank 144 may be designed so that it is orientated in a particular direction during use. Thus, fuel tank 144 may have a top side labeled "TOP" in FIG. 3 and a bottom side labeled "BOTTOM" in FIG. 3. For example, when fuel tank 144 is used in a vehicle, the top side may be positioned in a direction opposing the ground and the bottom side may be opposing the top side. In some examples, fuel system 140 may include a variety of components which adjust based on an orientation of the fuel tank for example, if a vehicle including fuel tank 144 tips over, one or more valves in the fuel system may be sealed to prevent fuel leakage from the fuel tank or to discontinue operation of the fuel tank.

A fuel delivery device 304 is included in fuel tank 144. Fuel delivery device 304 may include a variety of fuel system components which assist in delivery of fuel to engine 110 via liquid fuel delivery line 290. For example, fuel delivery device 304 may include a fuel pump 306, a fuel filter 308, and a pressure regulator 310. In some examples, fuel delivery line 290 may include a check valve 312 which substantially prevents fuel from flowing from the engine to the tank but substantially permits fuel to flow from the fuel tank to the engine, e.g., when pumped thereto.

In some examples, the fuel delivery device 304 may be positioned adjacent to a bottom side of the fuel tank, e.g. a base portion of the fuel delivery device may be coupled to a bottom side of the fuel tank. Fuel may be entrained from the fuel tank using fuel pump 306 via a plurality of apertures 311 located at a base portion of fuel delivery device 304.

Fuel tank 144 may include a fuel level sensor 314. Fuel level sensor 314 is configured to sense a level of liquid fuel contained in fuel tank 144. For example, fuel level sensor 314 may include a pivotal arm 316 with a float 318 attached thereto for sensing a fuel level 320. The pivotal arm may be coupled to a solenoid or variable resistor, for example, the signals of which are sent to controller 190. For example, float 318 may rise with increasing fuel level causing pivot arm 316 to pivot and rotate a solenoid to generate a signal to be sent to controller 190.

Fuel system 140 may include an evaporative emissions control system or a vapor recovery system. 297 coupled to fuel tank 144 via a vapor line 295. During some conditions, vapor line 295 may route vapors generated in the fuel tank to the vapor recovery system 297. For example, vapor line 295 may be coupled to the fuel tank via a vent valve 321. Vent valve 321 may include a float 322 so that valve 321 will close if liquid fuel reaches the level of the vent valve.

Vapor recovery system 297 may include one or more fuel vapor retaining devices. For example, vapor recovery system 297 may include a fuel vapor canister 328. Canister 328 may include a suitable adsorbent within which fuel vapor may be substantially stored. For example, canister 328 may include activated charcoal which may adsorb vaporized hydrocarbons.

In some examples, vapor line 295 may include a fuel tank isolation valve (FTIV) 326 disposed in vapor line 295 between the vent valve 321 and fuel canister 326, FTIV valve 326 may be configured to open and close vapor line 295. In one example, FTIV 326 may be a solenoid valve and operation of FTIV 326 may be regulated by a controller by adjusting a duty cycle of the dedicated solenoid. For example, during vehicle operation, FTIV 326 may be maintained in a closed state, such that refueling vapors may be stored in the canister on the canister side of the fuel vapor circuit and diurnal vapors may be retained in the fuel tank on the fuel tank side of the fuel vapor circuit. VFW 326 may be operated by controller 190 in response to a refueling request or an indication of purging conditions, for example. In these instances, FTIV 326 may be opened to allow diurnal vapors to enter the canister and relieve pressure in the fuel tank. Additionally, FTIV 326 may be operated by controller 190 to perform specific steps of leak detection, such as applying a pressure (positive pressure or vacuum) from fuel tank 144 to canister 328 during a first leak detection condition, or applying a vacuum from canister 328 to fuel tank 144 during a second leak detection condition. In this way, fuel vapor from fuel tank 144 may be selectively routed to fuel canister 328.

In some examples, vapor line 295 may include a check valve 324 disposed in vapor line 295 between vent valve 321 and FTIV 326. For example check valve 324 may substantially prevent intake manifold pressure from causing gases to flow in the opposite direction of the purge flow. As such, the check valve may be used if the canister purge valve control is not accurately timed or the canister purge valve itself can be forced open by a high intake manifold pressure, e.g., during boost conditions.

An atmosphere vent conduit 329 may be coupled to canister 328. Atmosphere vent conduit may include an atmosphere vent valve 330 disposed therein which may adjust a flow of air and vapors between fuel vapor recovery system 297 and the atmosphere. In this way, the fuel vapor canister may selectively communicate with the atmosphere under certain conditions. For example, controller 190 may energize the canister vent solenoid to close atmosphere vent valve 330 and seal the system from the atmosphere, such as during leak detection conditions. As another example, the canister vent solenoid may be at rest, the atmosphere vent valve 330 may be opened, and the system may be open to the atmosphere, such as during purging conditions. The air passing through the vent may be substantially stripped of fuel vapor by the canister.

In some examples under certain conditions, the fuel vapor recovery system 297 may deliver vaporized fuel to engine 110 via a fuel vapor delivery line 299 coupled thereto. A fuel vapor delivery valve 332 may be disposed in vapor delivery line 299. For example, vapor contained within the fuel canister may be periodically purged from the canister to refresh the adsorbent in the canister (e.g., to refresh the activated carbon within the canister) and delivered to the engine 110, e.g., injected into an intake manifold of engine 110.

The passive venturi pump and vacuum accumulator system 366 may be coupled to fuel system 140 so that vacuum generated by a venturi during vehicle motion may be stored in an accumulator 372 for use by vacuum consuming systems of the vehicle, such as the fuel tank or an emission control system such as fuel vapor recovery system 297. In some examples, vacuum stored in the accumulator may be used in other vacuum consuming systems of the vehicle such as a positive crankcase ventilation (PCV) system, or a vacuum amplifier for vacuum-powered actuators, for example.

Venturi 370 may be an ejector passive pump and may receive ambient air via an upstream air intake conduit 374 coupled to venturi 370 upstream of a direction of air flow through the venturi. For example, venturi 370 may generate vacuum when ran air passes through the venturi. Air may exit venturi 370 via a downstream air conduit 376 coupled to the venturi downstream of the direction of air flow through the venturi. In some examples, upstream conduit 374 may include an air filter 378 disposed therein and downstream conduit may include an air filter 379 disposed therein to filter air flowing in and out of venturi 370.

Upstream conduit 374 may be open to the atmosphere to receive ambient air during motion of the vehicle. For example, upstream conduit may be positioned toward a front side of the vehicle so that when the vehicle moves forward air flows through upstream conduit 375 and is directed through venturi 370 to generate vacuum via the venturi effect. For example, the intake of conduit 374 may face toward the front of the vehicle so that ram air may be received into conduit 375 and directed through venturi 370 during forward vehicle motion. In some examples, upstream conduit 374 may be coupled to an air intake of the engine, e.g., intake manifold 244, or any other suitable ambient air intake source in the vehicle.

In some examples, downstream conduit 376 may exhaust air back to the atmosphere after it flows through the venturi. However, in other examples, air exhaust from venturi 370 may be directed to an air intake of the engine, e.g., to intake manifold 244, or any other suitable air intake sources in the vehicle.

Venturi 370 may be coupled to accumulator 372 via a conduit 381 through a valve 380. Conduit 381 directs vacuum generated by venturi 370 into accumulator 372 for storage therein during select conditions. For example, valve 380 may be opened when the speed of the vehicle in a forward direction is greater than a threshold vehicle speed so that a threshold amount of vacuum is generated in the venturi. For example, accumulator 372 may store an amount of vacuum therein, e.g., as determined by a pressure sensor 386 and/or a temperature sensor 388 disposed in accumulator 372. Thus, in order to store more vacuum in the accumulator, in some examples, the vacuum generated by the venturi may be stored in the accumulator when the vacuum generated by the venturi is greater than the amount of vacuum stored in the accumulator. The amount of vacuum generated by the venturi may depend on how fast the vehicle is moving, or how much air is flowing through the venturi. Thus, in some examples, valve 380 may be opened to store vacuum in the accumulator when a speed of the vehicle is greater than a threshold speed where the threshold speed depends on a current amount of vacuum stored in the accumulator. For example, the threshold vehicle speed may increase with an increasing amount of vacuum stored in the accumulator.

Accumulator 372 may be coupled to fuel system 140 via a conduit 382 through a valve 384. For example, accumulator 372 may be coupled to atmosphere vent conduit 329 between canister 328 and vent valve 330 so that vacuum stored in the accumulator may be used during leak testing or refueling as described below. Though the accumulator is shown coupled to fuel system 140 in FIG. 3, the accumulator may be coupled to other vacuum consuming systems of the vehicle.

In response to certain entry conditions, e.g., as described in more detail below, vacuum stored in the accumulator may be at least partially discharged to one or more vacuum consuming systems of the vehicle. Following such vacuum discharges, vacuum may be replenished in the accumulator via the venturi during venturi motion for subsequent use.

A variety of sensors and/or diagnostic devices may be included in fuel system 140. For example, a pressure sensor 334, e.g., fuel tank pressure transducer (FTPT), may be coupled to fuel tank 144. Pressure sensor 334 may be configured to sense a pressure within the fuel tank. As another example, a temperature sensor 336 may be coupled to fuel tank 144 and configured to sense a temperature of the fuel tank. As still another example, a pressure sensor 360 and a temperature sensor 362 may be coupled to fuel canister 328. Sensor readings from the various sensors may be sent to the controller.

FIG. 4 shows an example method 400 for operating a vehicle, such as the hybrid electric vehicle shown in FIG. 1, with an engine and a venturi and accumulator, such as the passive venturi pump and vacuum accumulator system 366 shown in FIG. 3. Method 400 may be used to generate and store vacuum in a vehicle system for subsequent use by vacuum consuming systems of the vehicle. Method 400 utilizes a passive venturi pump which may reduce noise and power consumption leading to an increase in fuel efficiency, for example.

At 402, method 400 includes determining if the vehicle is in motion. For example, determining if the vehicle is in motion may be based on a speedometer reading, and/or one or more motion sensors in the vehicle. Further, determining if the vehicle is in motion may include determining a direction in which the vehicle is moving. For example, if the vehicle is moving forward and an air inlet to a venturi, such as venturi 370, faces a front side of the vehicle, then air may be caused to pass through the venturi to generate vacuum.

If the vehicle is not in motion at 402, method 400 proceeds to 403 to not direct air through the venturi to generate vacuum. However, if the vehicle is in motion at 402, then method 400 proceeds to 404.

At 404, method 400 includes directing air through a venturi to generate vacuum. For example, as the vehicle moves air may be caused to pass through a venturi, such as venturi 370, in order to generate vacuum based on the venturi principle. After flowing through the venturi, air may be directed back to the atmosphere or to an air intake of the vehicle for use by other air-consuming systems of the vehicle.

At 406, method 400 includes determining if entry conditions for storing vacuum in a vacuum accumulator are met. In some examples, entry conditions for storing vacuum in a vacuum accumulator may be based on a speed of the vehicle and direction of movement of the vehicle. For example, vacuum generated by the venturi may be provided to the accumulator for storage therein when a speed of the vehicle is greater than a non-zero threshold speed value and vacuum generated by the venturi may not be provided to the accumulator for storage therein when the speed of the vehicle is less than the non-zero threshold speed value. In particular, in some examples, vacuum may only be stored in the accumulator when a speed of the vehicle is greater than a non-zero threshold speed value. For example, valve 380 may be closed when the speed of the vehicle is less than the threshold speed value and opened when the speed of the vehicle is greater than or substantially reaches the threshold speed value.

As remarked above, the threshold speed value may be based on an amount of vacuum in the accumulator, e.g., as determined by a pressure sensor 386 disposed in the accumulator tank. For example, a higher amount of vacuum in the accumulator may cause the threshold speed value to increase so that sufficient vacuum is generated by the venturi for storage in the accumulator. In other words, in some examples, vacuum generated by the venturi may be stored in the accumulator when the vacuum generated by the venturi is greater than the amount of vacuum stored in the accumulator. Here, the amount of vacuum generated by the venturi may depend on how fast the vehicle is moving or how much air flows through the venturi where, for example, an increased speed of the vehicle leads to an increased air flow through the venturi which, in turn, leads to an increased amount of vacuum generated by the venturi. Thus, in some examples, vacuum generated by the venturi may be provided to the accumulator for storage therein when the amount of vacuum in the accumulator is less than a threshold vacuum value and vacuum generated by the venturi may not be provided to the accumulator for storage therein when the amount of vacuum in the accumulator is greater than the threshold vacuum value.

If entry conditions for storing vacuum are met at 406, method 400 proceeds to 408. At 408, method 400 includes storing vacuum generated by the venturi in the accumulator device. For example, valve 380 may be opened during vehicle motion when the entry conditions are met so that vacuum generated by the venturi is used to charge the accumulator with vacuum. In some examples, vacuum may be provided to the accumulator until a threshold vacuum is reached in the accumulator, e.g., as monitored by pressure sensor 386 in the accumulator. When the threshold vacuum is reached in the accumulator, valve 380 may be closed so as to discontinue providing vacuum generated by the venturi to the accumulator. This threshold vacuum value may be based on a vacuum storage capacity of the accumulator device and/or on vacuum generating properties of the venturi, for example.

At 410, method 400 includes determining if entry conditions for discharging stored vacuum are met. For example, entry conditions for discharging stored vacuum may be based on an amount of vacuum stored in the accumulator. For example, depending on the application, a vacuum consuming system may use a specified amount of vacuum, for example to perform leak testing, pressure reductions, etc. Thus, entry conditions for discharging stored vacuum may be based on an amount of vacuum stored in the accumulator greater than a predetermined threshold value.

Further, entry conditions for discharging stored vacuum may be based on various engine and/or vehicle operating conditions. For example, in response to a an engine-off event or a key-off event, where the vacuum consuming system is a fuel system of the vehicle or an fuel evaporative system of the vehicle, vacuum may be discharged from the accumulator for leak testing or to reduce pressure in the fuel tank, fir example. As another example, in response to a vehicle-on condition, vacuum may be discharged from the accumulator to a vehicle emission control system to performing leak diagnostics, for example. As still another example, in response to a refueling event request, vacuum may be discharged from the accumulator to reduce pressure in the fuel tank before refueling.

If entry conditions for discharging stored vacuum are met at 410, method 400 proceeds to 412. At 412, method 400 includes discharging vacuum stored in the accumulator to a vacuum consuming system of the vehicle. For example, vacuum stored in the accumulator may be discharged to an emission control system of the vehicle, a fuel system or fuel tank of the vehicle, and/or other vacuum consuming devices of the vehicle, as described in the examples shown in FIGS. 5 and 7 described below.

Figure 5:
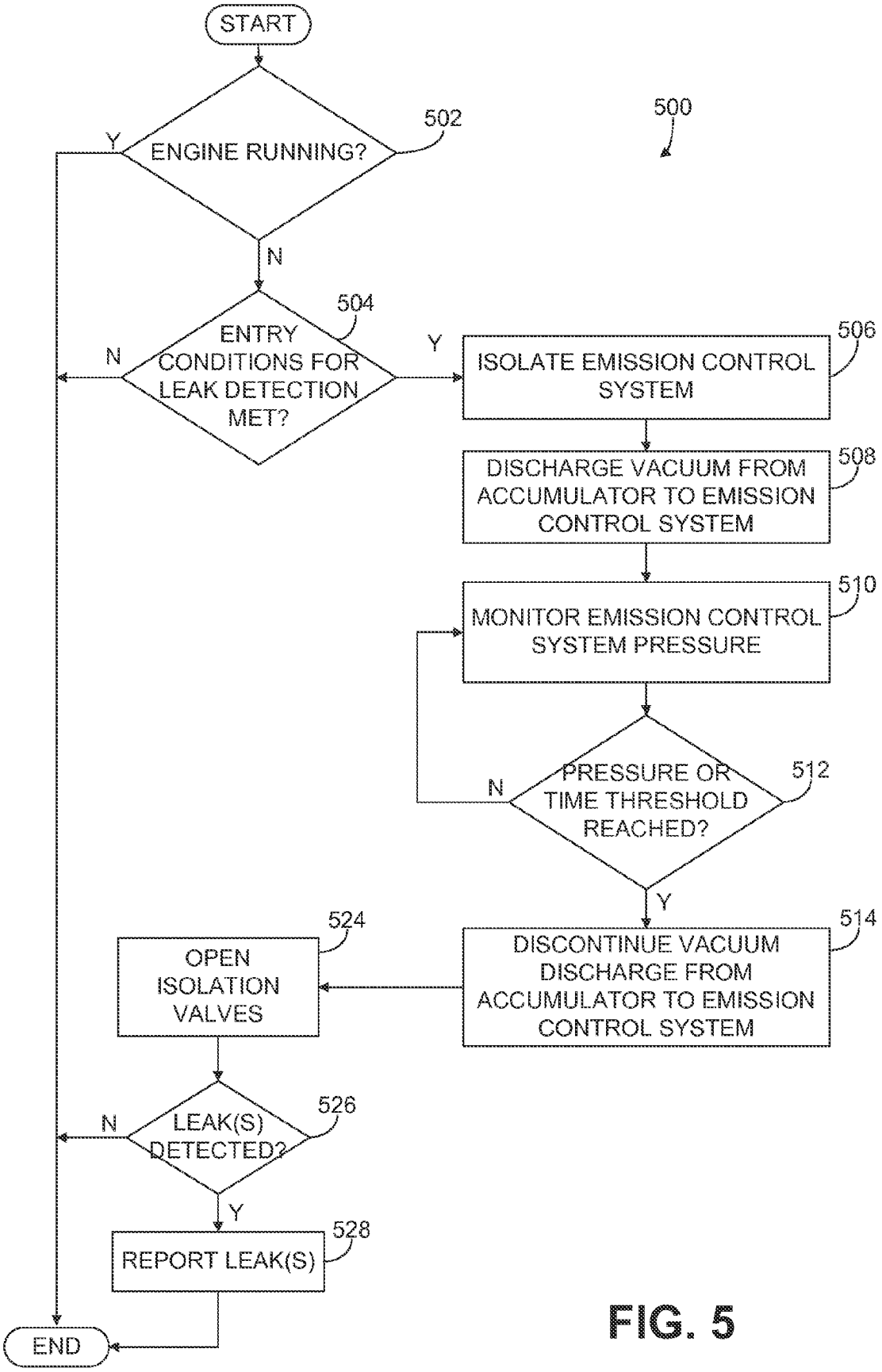
FIG. 5 shows an example method for diagnosing leaks in a fuel system in accordance with the disclosure.
Figure 6:
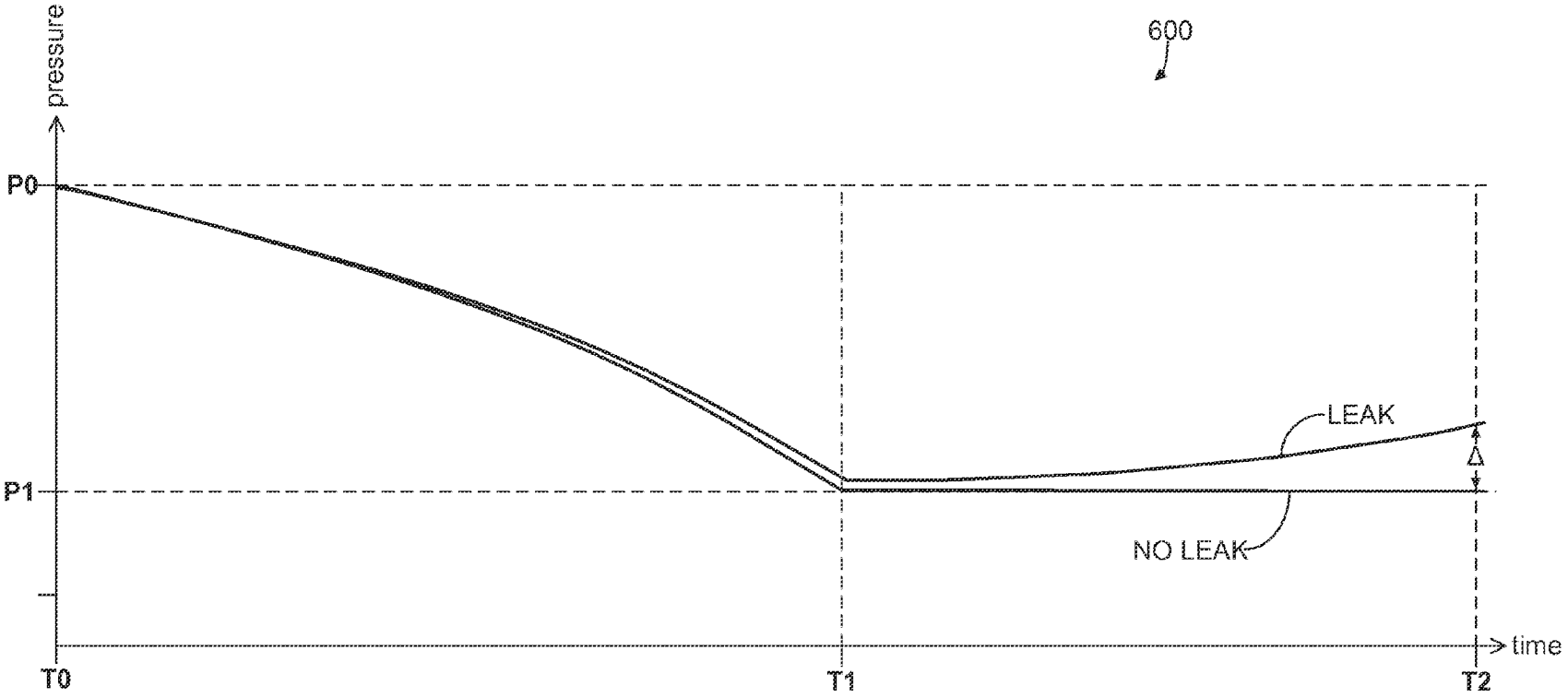
FIG. 6 shows example plots of pressure changes which may occur during leak testing.

FIG. 5 shows an example method 500 for diagnosing leaks in an emission control system or a fuel system using an accumulator charged with vacuum via a venturi as described above.

At 502, method 500 includes determining if the engine is running. For example, hybrid or plug-in hybrid vehicle systems may have two modes of operation: an engine-off mode and an engine-on mode. While in the engine-off mode, power to operate the vehicle may be supplied by stored electrical energy. While in the engine-on mode, the vehicle may operate using engine power. Thus, in this example, determining if the engine is running may include determining a mode in which a vehicle is operating, e.g., engine-on mode or engine-off mode. As another example, determining if the engine is running may include determining if an engine has just been stopped, e.g., in response to a key-off event, e.g., as performed by a driver of a vehicle, or in response to a change in a mode of operation of a vehicle, e.g., switching from an engine-on mode to an engine-off mode. In yet another example, determining if the engine is running may include determining if the engine is about to be started, e.g., in response to a key-on event, e.g., as performed by a driver of a vehicle, or in response to a change in a mode of operation of a vehicle, e.g., switching from an engine-off mode to an engine-on mode.

If the engine is not running at 502, method 500 proceeds to 504. At 504, method 400 includes determining if entry conditions for leak detection are met. Entry conditions for leak detection may include a variety of engine and/or fuel system operating conditions and parameters. Additionally, in the case when the engine is included in a vehicle, entry conditions for leak detection may include a variety of vehicle conditions.

For example, entry conditions for leak detection may include a temperature of one or more fuel system components in a predetermined temperature range. For example, temperatures which are too hot or too cold may decrease accuracy of leakage detection. Such a temperature range may depend on the method used to calculate the leak detection and the sensors employed. However, in some examples, leak detection may occur at any temperature.

As another example, entry conditions for leak detection may include an amount of time since a prior leak testing. For example, leak testing may be performed on a set schedule, e.g. leak detection may be performed after a vehicle has traveled a certain amount of miles since a previous leak test or after a certain duration has passes since a previous leak test.

As another example, entry conditions for leak detection may include a door opening. For example, leak detection may occur when a driver opens a door, e.g., indicating that the driver is about to leave the vehicle.

As another example, entry conditions for leak detection may include a door closing. For example, leak detection may occur when a driver closes the door, e.g., potentially indicating that the car is about to be started.

As another example, entry conditions for leak detection may include a key-off event, e.g., as performed by a driver of a vehicle. For example, leak detection may be performed following a key-off event.

As another example, entry conditions for leak detection may include a key-on event, e.g., as performed by a driver of a vehicle. For example, leak detection may be performed immediately following a key-on event before the engine starts, or an engine may start in an engine-off mode and leak detection may be performed at each key-on and/or key-off event.

As another example, entry conditions for leak detection may be based on a vehicle operating mode change. For example, leak detection may be performed following a transition from engine-on mode to engine-off mode.

As another example, entry conditions for leak detection may include whether or not a leak has previously been detected. For example, if a leak was detected by a prior leak test, then leak testing may not be performed, e.g., until the leak is fixed and an onboard diagnostic system reset.

As another example, entry conditions for leak detection may include if a refueling event is taking place. For example, leak detection may not be performed while the fuel tank is being refilled or when the fuel cap is off, etc.

As another example, entry conditions may be based on an amount of vacuum stored in the accumulator. For example, entry conditions may include an amount of vacuum in the accumulator larger than a threshold vacuum value, where the threshold vacuum value is based on an amount of vacuum used during the leak testing procedure.

If entry conditions for leak detection are met at 504, method 500 proceeds to 506. At 506, method 500 includes isolating the emission control system or fuel system from the atmosphere. Isolating the emission control system or fuel system from the atmosphere may include adjusting one or more valves. For example, vent valve 330 may be closed to isolate the fuel vapor recovery system 297 from the atmosphere. Further, in some examples, if leak testing is to be preformed on fuel vapor recovery system 297 and not fuel tank 144, then valve 326 may be closed to isolate the fuel tank from the fuel vapor recovery system 297. However, in other examples, valve 326 may be opened so that leaks ma be diagnosed in the entire fuel system. Additionally one or more valves may be closed in the fuel line 290 and fuel vapor delivery valve 332 may be closed.

At 508, method 500 includes discharging vacuum from the accumulator to the emission control system. For example, valve 384 may be opened so that vacuum stored in accumulator 370 is discharged to fuel vapor recovery system 297 to evacuate the evaporative emission system for leak testing. In some examples, a predetermined amount of vacuum may be discharged from the accumulator to the emission control system. For example, valve 384 may be opened for a duration based on an amount of vacuum in the accumulator as determined by pressure sensor 386 disposed in the accumulator, for example.

In some examples, at 510, method 500 may include monitoring the pressure of the emission control system during discharge of vacuum from the accumulator. For example, a pressure sensor in the fuel vapor recovery system, e.g., sensor 360, may be used to monitor pressure changes in the fuel vapor recovery system while vacuum is being discharged from the accumulator. Additionally, a temperature of the fuel tank may be monitored. In some examples, a temperature sensor, e.g., sensor 336 and/or sensor 362, may sample the temperature of the fuel tank and/or fuel vapor recovery system one or a plurality of times while vacuum is being discharged from the accumulator. For example, throughout the monitoring process, a pressure curve may be generated, e.g. as shown in FIG. 6 described in more detail below. The pressure and temperature readings may be stored in a memory component of a controller for further processing. For example, an initial pressure may be measured when the vacuum starts to be discharged from the accumulator and subsequent measurements may be performed thereafter. In some examples, sample rates of such measurements may be varied depending on the accuracy desired and the length of time vacuum is discharged from the accumulator. In other examples, an initial pressure before vacuum is discharged from the accumulator and a final pressure immediately following a discontinuation of discharge of vacuum from the accumulator may be used to determine if a leak is present.

At 512, method 500 includes determining if a pressure and/or time threshold is reached. In some examples, vacuum may be discharged from the accumulator for a predetermined period of time. In other examples, the pressure may be monitored and the vacuum discharge from the accumulator stopped when the pressure reaches a threshold pressure. For example, vacuum may be discharged from the accumulator until the pressure in the emission control system reaches an expected pressure (e.g., to give the expected pressure change). However, the time it takes to reach this threshold may be used to determine whether there is a leak or not. In some examples, if there is a leak, the pressure threshold may never be reached thus the method may discontinue vacuum discharge from the accumulator after a predetermined time threshold.

If a pressure and/or time threshold is not reached at 512, method 500 proceeds back to step 510 to continue discharging vacuum from the accumulator and monitoring the pressure in the emission control system. However, if the pressure and/or time threshold is reached at 512, method 500 proceeds to 514.

At 514, method 500 includes discontinuing vacuum discharge from the accumulator to the emission control system once the pressure and/or time threshold is reached. As described above, leak diagnosis may then be performed based on the pressure, temperature, and or time data as described above. If a leak is detected in the fuel tank, a flag may be stored in the memory component, and sent to an onboard diagnostic system to alert a vehicle operator of the leak, for example.

Immediately following cessation of vacuum discharge from the accumulator in step 514, a vacuum may be present in the emission control system. The amount of vacuum present may depend on whether there is a leak or no leak. In some examples, this vacuum in the emission control system may be used to diagnose leaks in other fuel system components which may be put in communication with the emission control system. For example, if valve 326 remained closed during the above-described process, then valve 326 may be opened to provide vacuum to the fuel tank in order to monitor for leaks in the fuel tank as well.

At 524, method 500 includes opening isolation valves. This step may be optional and may depend on various operating conditions of the vehicle.

At 526, method 500 includes determining if one or more leaks were detected in the previous steps. For example, as described above, the pressure changes may be compared to expected pressure changes and flags may be set in a memory component with information indicating which components leaks were detected in.

If no leaks were detected, the method ends. However, if one or more leaks were detected, method 500 proceeds to 528. At 528, method 500 includes reporting the detected leaks. For example, if leaks were found during testing, an onboard diagnostic system (OBD) may be notified to report the leaks to an operator so that the leaking components may be serviced. For example, notification may be sent to message center 196. In some examples, various operating conditions of the engine and/or vehicle may be modified based on where leaks are detected. Additionally, in some examples, leak testing may not be performed again until the leaking components are serviced and the OBD reset.

Since the methods described above may be implemented during engine-off conditions, this approach may provide a greater amount of flexibility in deciding when a leak test may be implemented. For example, under some conditions, the method may be carried out during engine off conditions and after component (such as the engine as indicated by engine coolant temperature) temperatures have cooled to ambient temperatures. Under other conditions, the method may be carried out directly after engine shutdown and before components cool to ambient temperature. For example, the former conditions may include higher ambient temperatures than the latter.

Further, the duration of the leak test may be varied. For example, shorter test times may result in smaller vacuum changes whereas longer test times may result in larger vacuum changes. However, leak detection may still be effectively implemented with sufficient accuracy even during shorter test times. For example, the test durations may be selected based on engine shut-down conditions, such as whether the vehicle is active and travelling, or whether the vehicle is shut-down, with the latter having a longer test duration.

FIG. 6 shows example plots 600 of pressure changes which may occur in an emission control system or a fuel tank during leak testing, e.g., as performed by method 500 described above. The plots in FIG. 6, show pressure (y-axis) as a function of time (x-axis). As described above, when vacuum is discharged from the accumulator to the emission control system, pressure may decrease in the emission control system. FIG. 6 shows two curves which have different rates of pressure decrease with increasing time. A first pressure curve labeled "NO LEAK" is an example pressure curve for an emission control system or fuel tank which does not have a leak, or has a sufficiently small leak. A second pressure curve labeled "LEAK" shows an example pressure curve for a device which has a leak.

When leak testing is initiated as described above, at time T0, vacuum discharge from the accumulator to the device being tested is initiated. An initial pressure P0 is measured in the device being tested for leaks, e.g., before or at time T0. As vacuum is discharged from the accumulator to the device, a vacuum is generated in the device being leak tested as indicated by the decreasing pressures shown in the curves.

As described above, the leak testing continues until a time T1 at which vacuum discharge from the accumulator to the device is discontinued. Time T1 may be a predetermined time or may be a time at which the pressure reaches a threshold pressure value P1. In some examples, however, pressure may continue to be monitored for leak testing after vacuum discharge from the accumulator to the device is discontinued.

A variety of methods may be employed to determine if a leak is present in the device based on pressure changes during and/or after a generation of a vacuum within the device. In one example, to determine if a leak is in the device, a final pressure measured after the vacuum discharge from the accumulator is discontinued (after T1) may be used to determine a change in pressure relative to the initial pressure P0. This change in pressure may then be compared to an expected change in pressure to determine is a leak is present. For example, if the determined pressure change after a vacuum is generated in the device is sufficiently different, e.g., by a threshold amount, from the expected change in pressure then a leak may be reported.

As another example, the pressure of the device may be monitored for a predetermined duration following the vacuum generation in the device being leak tested. In such an approach, an increase in pressure above a threshold value may indicate that a leak is present in the device.

The example curves shown in FIG. 6 give an example of no leak being detected and a leak being detected. For the no leak curve, the pressure at T1 is substantially equal to the expected pressure P1, indicating that no leak is present. However, in the leak curve, the pressure at T1 is greater than the expected pressure P1 by a threshold amount, indicating that a leak may be present.

However, in some examples, during generation of a vacuum in the device when vacuum is being discharged from the accumulator, the pressure curves generated during both leak and no leak scenarios may be substantially the same. In such examples, the pressure may be monitored for a predetermined duration following discontinuation of vacuum discharge from the accumulator at T1 to determine if a leak is present in the device or not. Vacuum discharge from the accumulator may be discontinued at T1 when a selected vacuum level is reached, for example. At time T2 which follows the discontinuation of vacuum discharge from the accumulator by a preselected duration, the pressure in the device may be measured to determine if the pressure in the device is different by a threshold amount than the expected pressure P1. For example, as shown in FIG. 6, when no leak is present, the pressure in the device following discontinuation of vacuum discharge from the accumulator at T1 remains substantially equal to the expected pressure P1. Whereas, when a leak is present, the pressure in the device following discontinuation of vacuum discharge from the accumulator at T1 may rise due to a leak. For example, if a leak is present, the pressure in the device at T2 may differ from the expected pressure by an amount A, which may be a predetermined threshold amount. Alternatively, the time required to reach a selected vacuum level may also be used.

Figure 7:
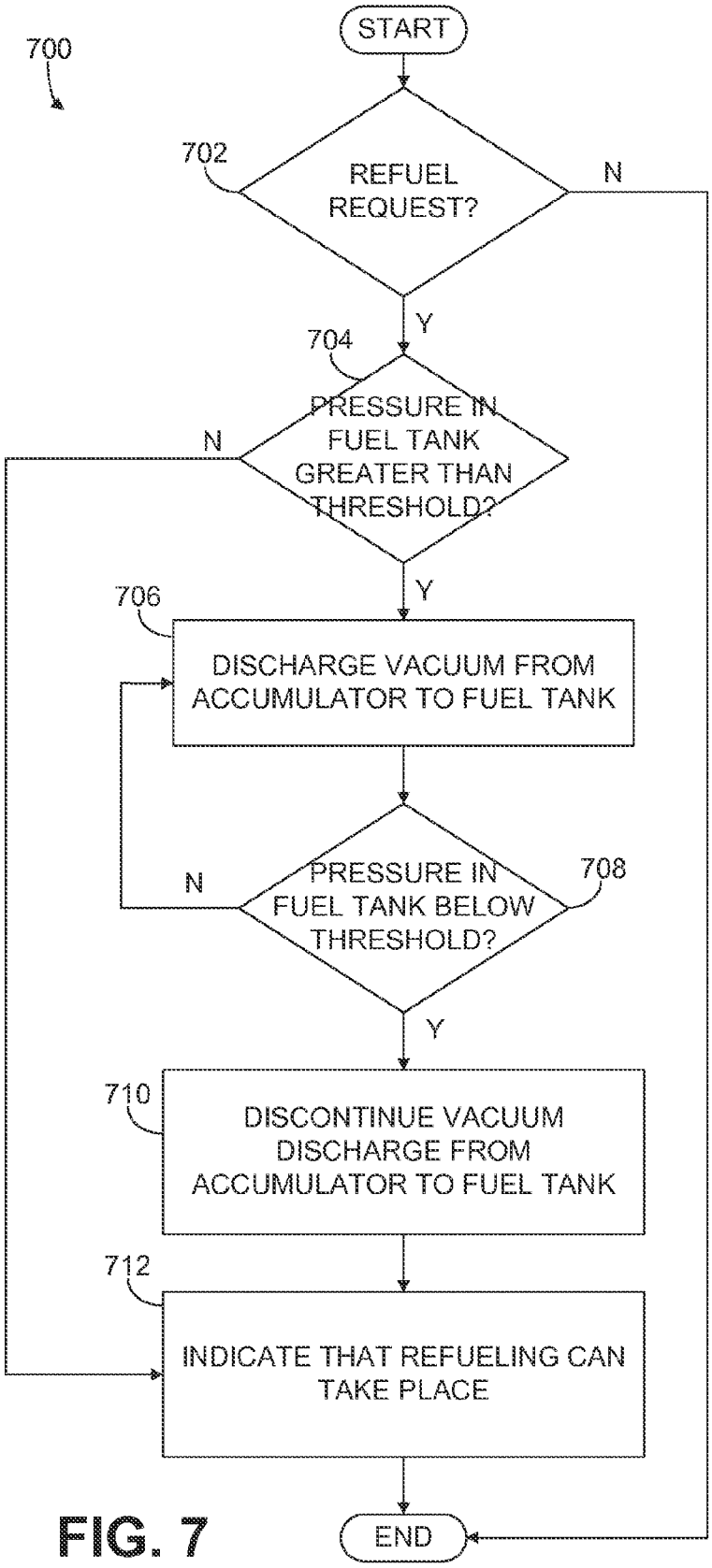
FIG. 7 shows an example method for reducing pressure in a fuel tank for refueling in accordance with the disclosure.

FIG. 7 shows an example method 700 for reducing pressure in a fuel tank for refueling a vehicle, such as the hybrid electric vehicle shown in FIG. 1, with an engine and a venturi and accumulator, such as the passive venturi pump and vacuum accumulator system 366 shown in FIG. 3.

For example, under high ambient conditions it is possible for the fuel to store a significant amount of energy. When a customer requests a refueling event, e.g., via an electronically controlled activated door, such as refueling door 368, the fuel can begin to boil in the fuel tank and thus create a very long time for the pressure in the fuel tank to reach a targeted pressure, e.g., a pressure threshold of 10' H20. When the pressure in the fuel tank reaches the targeted pressure, the refueling door may be activated by a controller. In method 700, the vacuum stored in the accumulator may be used to pull a flow rate out of the fuel tank to aid in the decrease in pressure so that a customer can refuel with a reduced delay.

At 702, method 700 includes determining if a refueling event request occurs. For example, a refueling event request may occur in response to an activation attempt by a user of the vehicle, e.g., a refueling door key, a lever of button in the vehicle actuated to open a refueling door, etc. In some examples, a valve in the refueling line may remain closed until the pressure in the fuel tank decreases to a threshold pressure value. In this example, a refueling event request may include a fuel cap, such as fuel cap 364, removed.

As another example, a refueling event request may occur following an engine-off event or a key-off event. For example, the refueling door may be locked during engine operation and/or when pressure in the fuel tank, e.g., as measured by pressure sensor 334 disposed in fuel tank 144, is above a threshold pressure value, e.g., above 10' H20. When the pressure in the fuel tank falls below the pressure threshold the refueling door may be unlocked or activated via actuator 369 so that refueling can take place.

If a refueling event request occurs at 702, method 700 proceeds to 704. At 704, method 700 includes determining if pressure in the fuel tank is greater than a threshold pressure value. For example, pressure sensor 334 disposed in fuel tank 144 may be used to determine if pressure in the fuel tank is greater than a threshold pressure value.

If pressure in the fuel tank is not greater than the threshold pressure value, for example if pressure in the fuel tank is less than the threshold pressure value at 704, then method 700 proceeds to 712 to indicate that refueling can take place. However, if pressure in the fuel tank is greater than a threshold pressure value at 704, then method 700 proceeds to 706.

At 706, method 700 includes discharging vacuum from the accumulator to the fuel tank. For example, valve 384 may be opened so that vacuum stored the accumulator may be directed to fuel tank 144.

At 708, method 700 includes determining if the pressure in the fuel tank falls below the threshold pressure value. If pressure in the fuel tank does not full below the threshold pressure value, then discharge of vacuum from the accumulator to the fuel tank may be continued at 706 until the pressure in the fuel tank falls below the threshold pressure value. In this way, pressure reduction in the fuel tank may be accelerated by employing vacuum stored in the accumulator.

If the pressure in the fuel tank is below the threshold pressure value at 708, then method 700 proceeds to 710 to discontinue vacuum discharge from the accumulator to the fuel tank. For example, valve 384 may be closed to isolate the accumulator from the fuel tank.

At 712, method 700 includes indicating that refueling can take place. For example, refueling door 368 may be activated or unlocked via an actuator, such as actuator 369, so that refueling can take place. As another example, a valve in the refueling line may be opened so that refueling can take place.

Note that the example systems and methods included herein can be used with various engine and/or vehicle system configurations. The specific routines described herein may represent one or more of any number of processing strategies such as event driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be encoded as microprocessor instructions and stored into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, gasoline, diesel and other engine types and fuel types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method for operating a vehicle with an engine, comprising:

during vehicle motion, passing air through a venturi coupled to the vehicle to generate vacuum;

selectively storing the generated vacuum in an accumulator by controlling a valve arranged in a conduit coupling the venturi with the accumulator based on vehicle speed and an amount of accumulator vacuum; and in response to a condition, discharging the stored vacuum to a vacuum consuming system of the vehicle.

2. The method of claim 1, wherein the condition is an engine-off event or a key-off event, and the vacuum consuming system is a fuel system of the vehicle.

3. The method of claim 1, wherein the condition is an engine-off event or a key-off event, and the vacuum consuming system is a fuel evaporative system of the vehicle.

4. The method of claim 1, wherein the vehicle is a hybrid electric vehicle.

5. The method of claim 1, further comprising controlling the valve to provide vacuum generated by the venturi to the accumulator for storage therein when a speed of the vehicle is greater than a threshold speed value and controlling the valve to not provide vacuum generated by the venturi to the accumulator for storage therein when the speed of the vehicle is less than the threshold speed value.

6. The method of claim 5, further comprising monitoring an amount of vacuum in the accumulator and wherein the threshold speed value is increased based on an increased amount of vacuum stored in the accumulator.

7. The method of claim 1, further comprising monitoring an amount of vacuum in the accumulator and providing vacuum generated by the venturi to the accumulator for storage therein when the amount of vacuum in the accumulator is less than a threshold vacuum value and not providing vacuum generated by the venturi to the accumulator for storage therein when the amount of vacuum in the accumulator is greater than the threshold vacuum value.

8. The method of claim 1, further comprising, in response to a vehicle-on condition, performing leak diagnostics using vacuum stored in the accumulator.

9. The method of claim 1, further comprising indicating a leak in an emission control system of the vehicle in response to vacuum stored in the accumulator.

10. The method of claim 1, wherein the condition is a refueling event request, and the vacuum consuming system is a fuel tank of the vehicle.

11. The method of claim 1, further comprising, in response to a refueling event request, discharging vacuum stored in the accumulator into a fuel tank and indicating that a refueling event can take place when a pressure in the fuel tank decreases to a threshold pressure value.

12. A method of operating an engine emission control system in a hybrid vehicle, comprising:

during vehicle motion, passing ram air through a venturi coupled to the vehicle to generate vacuum;

selectively storing the generated vacuum in an accumulator until an engine-off condition, monitoring an amount of vacuum in the accumulator with a pressure sensor arranged in the accumulator, and increasing a threshold speed value based on an increased amount of vacuum stored in the accumulator, wherein selectively storing the generated vacuum includes controlling a valve arranged in a conduit coupling the venturi with the accumulator based on vehicle speed and an amount of accumulator vacuum, including controlling the valve to provide vacuum generated by the venturi to the accumulator for storage therein when a speed of the vehicle is greater than the threshold speed value and controlling the valve to not provide vacuum generated by the venturi to the accumulator for storage therein when the speed of the vehicle is less than the threshold speed value; and during the engine-off condition, isolating the emission control system from the atmosphere and indicating a leak in response to depletion of stored vacuum.

13. The method of claim 12, wherein the emission control system includes a fuel vapor canister, and the method further comprises isolating the fuel vapor canister from the atmosphere before opening a communication between the accumulator and the fuel vapor canister.

14. The method of claim 12, wherein a leak is indicated in response to a pressure change in the emission control system and said indicating includes reporting said leak to an onboard diagnostic system of the vehicle.

15. The method of claim 12, further comprising monitoring the amount of vacuum in the accumulator and providing vacuum generated by the venturi to the accumulator for storage therein when the amount of vacuum in the accumulator is less than a threshold vacuum value and not providing vacuum generated by the venturi to the accumulator for storage therein when the amount of vacuum in the accumulator is greater than the threshold vacuum value.

16. The method of claim 12, further comprising, in response to a refueling event request, discharging vacuum stored in the accumulator into a fuel tank and indicating that a refueling event can take place when a pressure in the fuel tank decreases to a threshold pressure value.

17. A hybrid vehicle system, comprising:

an engine emission control system including a fuel vapor retaining device coupled to a fuel tank;

a vacuum accumulator coupled to the engine emission control system through a first valve;

a venturi coupled to an ambient air intake, where the venturi is coupled to the accumulator through a second valve;

a pressure sensor disposed within the emission control system;

a pressure sensor disposed in the accumulator;

a vehicle speed sensor; and a computer readable storage medium having instructions encoded thereon, including:

instructions to, in response to vehicle motion, open the second valve and close the first valve to charge the accumulator with vacuum generated by the venturi;

instructions to close the second valve and maintain the first valve closed to store vacuum generated by the venturi in the accumulator;

instructions to open the first valve to discharge vacuum stored in the accumulator to the emission control system for a duration;

instructions to indicate a leak in the emission control system in response to a pressure change in the emission control system during the duration; and instructions to open the second valve and close the first valve to charge the accumulator with vacuum generated by the venturi when a speed at which the vehicle is traveling is greater than a threshold speed value and close the second valve to not charge the accumulator with vacuum generated by the venturi when the speed at which the vehicle is traveling is less than the threshold speed value, wherein the threshold speed value is based on an amount of vacuum stored in the accumulator.

18. The system of claim 17, further comprising a fuel tank coupled to the emission control system, and a pressure sensor disposed in the fuel tank wherein the computer readable storage medium further includes instructions to, in response to a refueling event request, open the first valve to discharge vacuum stored in the accumulator into the fuel tank and indicate that a refueling event can take place when a pressure in the fuel tank decreases to a threshold pressure value.

* * * * *